United States Patent [19]

Jensen

[11] 3,998,203

[45] Dec. 21, 1976

[54] AIR HEATER FOR FIREPLACES

[76] Inventor: Peter Jarl Jensen, 1946 Northfield Road, Nanaimo, B. C., Canada

[22] Filed: Mar. 19, 1975

[21] Appl. No.: 559,920

[52] U.S. Cl. ..... 126/122; 126/131; 126/286; 126/288; 237/51

[51] Int. Cl.[2] ..... F24B 7/04

[58] Field of Search ..... 126/120, 121, 130, 131, 126/122, 108, 286, 288; 237/51

[56] References Cited

UNITED STATES PATENTS

| | | | |
|---|---|---|---|
| 310,277 | 1/1885 | Hayes | 126/121 |
| 367,255 | 7/1887 | Vance | 126/122 |
| 485,301 | 11/1892 | Scates | 126/122 |
| 549,720 | 11/1885 | Hayes | 126/121 |
| 578,240 | 3/1897 | Humphreys | 237/51 |
| 1,468,964 | 9/1923 | Groth | 126/121 |
| 2,199,836 | 5/1946 | Mairs | 237/51 |
| 2,471,351 | 5/1949 | Russell | 237/51 |

*Primary Examiner*—Ronald C. Capossela
*Attorney, Agent, or Firm*—Carver and Company

[57] ABSTRACT

An air heater for installation in a fireplace located in a room to be heated having a lower metalic portion having a hollow back wall surmounted by a flue portion also having a hollow back wall communicating with the hollow back wall of the lower portion so as to form a common heating chamber. The heating chamber has an opening at its lower end for receiving air to be heated from outside of the room in which the fireplace is located and has a plurality of ducts extending across the flue portion at the upper end of the heating chamber for permitting escape of the heated air into the room to be heated and a vent pipe extending from the upper end of the heating chamber to vent heated air outside of the room in which the fireplace is located. The air ducts and vent pipe are opened and closed by the operation of valves so arranged that when the air ducts are opened to the passage of air the vent pipe is closed and the vent pipe is open when the air ducts are closed.

3 Claims, 4 Drawing Figures

AIR HEATER FOR FIREPLACES

BACKGROUND OF THE INVENTION

1. Field of the Invention

This invention relates to heaters for installation in fireplaces.

2. Prior Art

Fireplace heaters of prior art construction usually employ a heat exchanger into which cold air from outside or inside the room to be heated is drawn, and is then heated by the burning material in the fireplace and is then passed outwards into the room. With this type of heater the energy of combustibles in the fireplace is used more efficiently than is obtained by mentioned fireplaces where most of the heat passes up through the chimney.

Most such heaters, however, do not provide means for wasting heat so that in warm wheather the burning of waste combustible materials makes the room in which the fireplaces are constructed, uncomfortably hot.

SUMMARY OF THE INVENTION

The present invention provides an air heater for fireplaces which enables fresh air to be heated and discharged into the room in which the fireplace is located and yet can be arranged to discharge heated air out of the room.

The air heater of the present invention furthermore efficiently utilizes, when required, heat generated by burning combustibles in the fireplace.

The air heater of the present invention is, furthermore, relatively easily to manufacture and can be readily installed in most fireplaces.

The air heater of the present invention is of metalic construction and includes a lower grate portion open at its front, having a hollow back wall having an opening at its lower end for receiving air from outside the room in which the fireplace is located, an upper flue portion having a front wall and having a hollow back wall in communication with the hollow back wall of the lower portion so as to provide a common heating chamber, a plurality of air ducts extending across the flue portion in the path of combustion ported at their inner ends into the upper end of the heating chamber and at their outer ends through the front wall of the flue portion for discharging heated air into the room to be heated, a vent pipe extending from the upper end of the heating chamber for discharging air out of the room to be heated, valve means in both the ducts and the vents for opening and closing the latter and means connecting the valves and the ducts in the vents for opening the vent valves when the duct valves are closed and for closing the vent valves when the duct valves are open.

A detailed description following, related to the drawings, gives exemplification of apparatus according to the invention which, however, is capable of expression in means other than those particularly described and illustrated.

DETAILED DESCRIPTION

Figure 1:
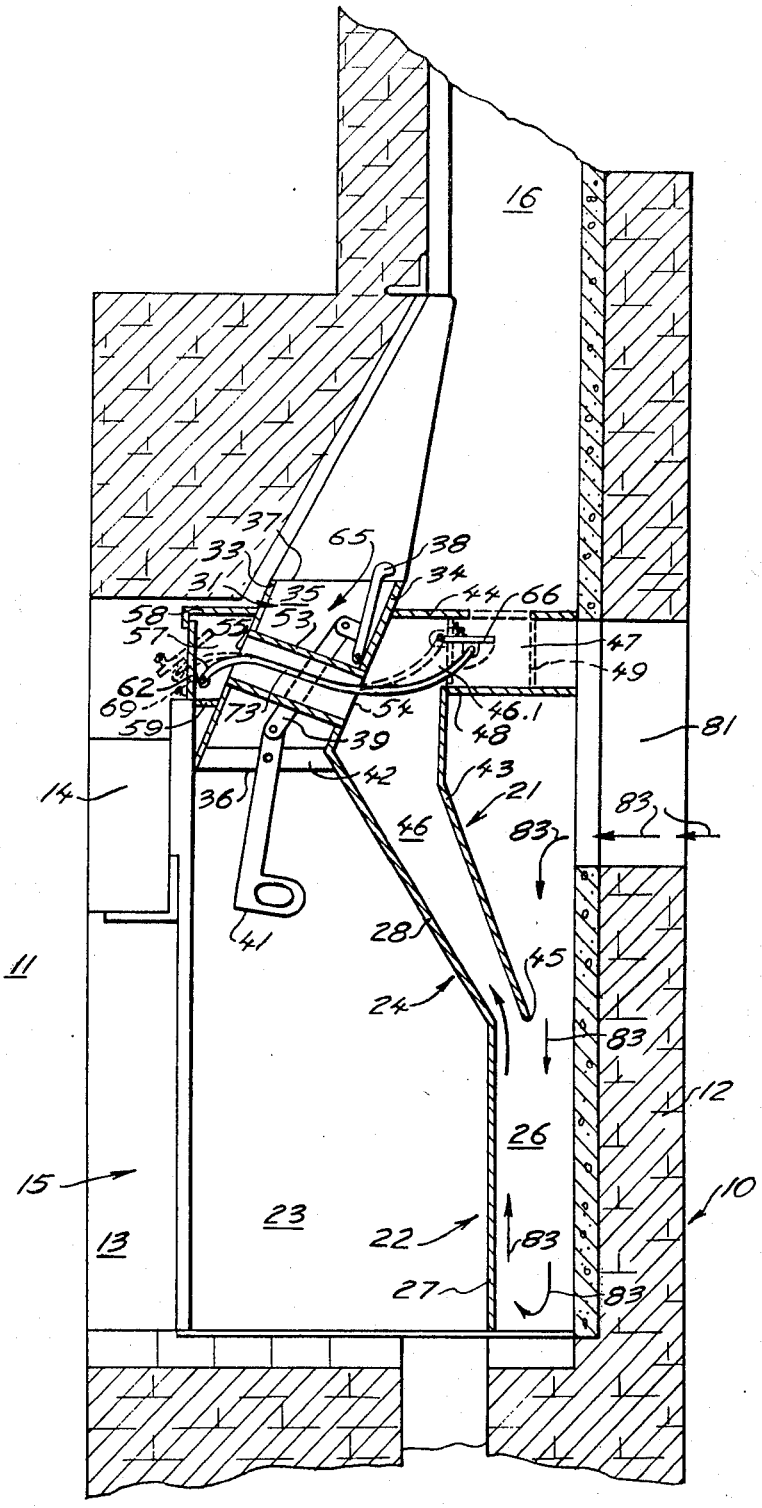
FIG. 1 is central sectional view of the air heater installed in a fireplace.
Figure 3:
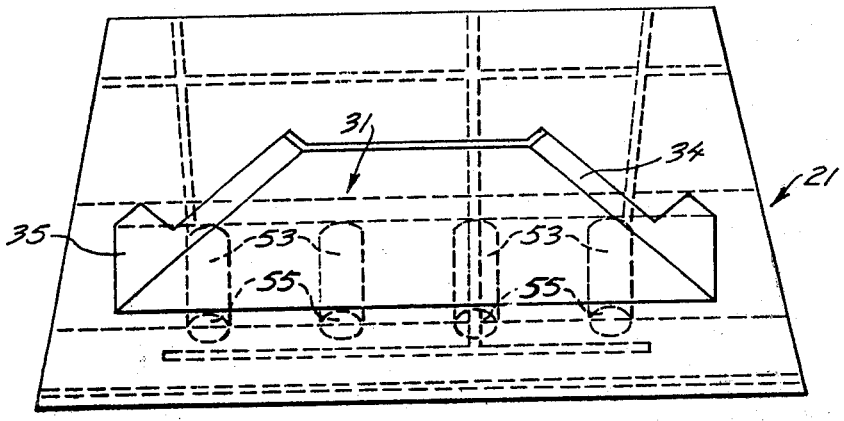
FIG. 3 is a plan view of a portion of the air heater showing position of the air ducts, in broken outline.
Figure 2:
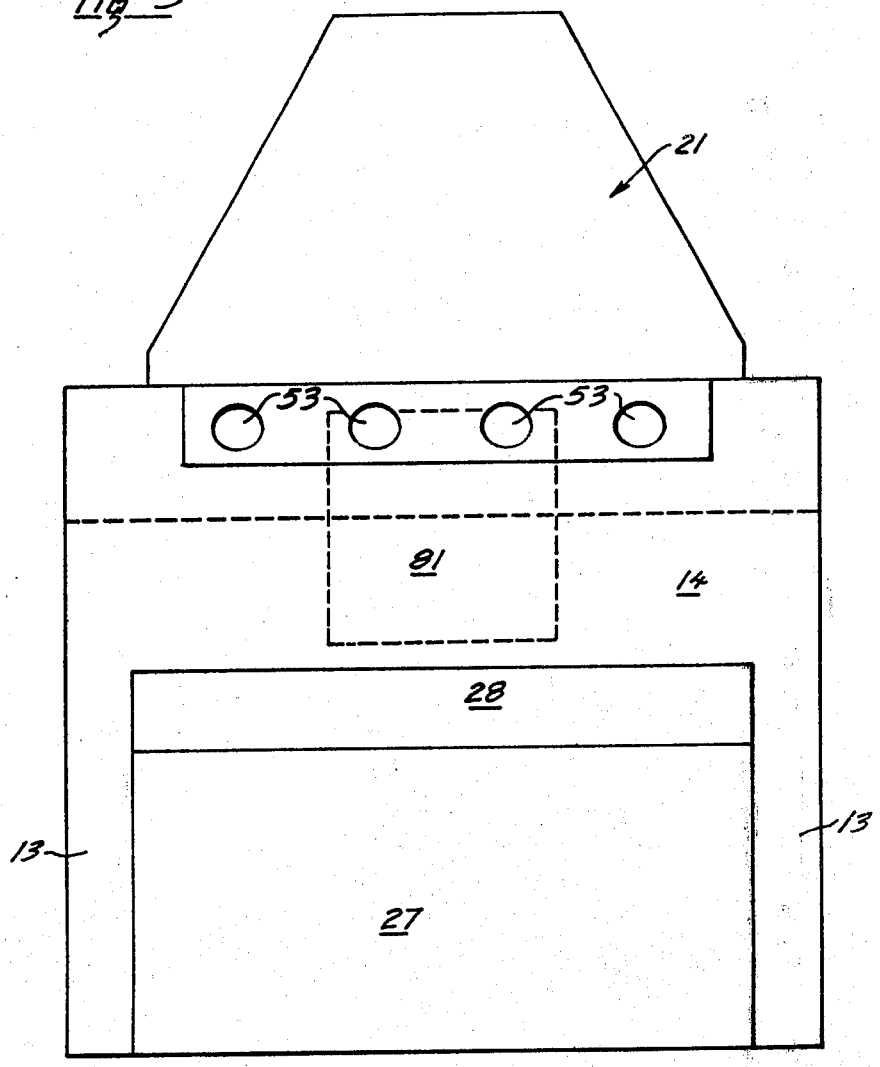
FIG. 2 is an elevation of the fireplace showing, in broken outline, portions of the air heater therein.

Referring to the drawings, the numeral 10 designates a conventional fireplace which is made of brick or other refractory material and which is built as a portion of an outside wall of a house for heating a room, generally 11. The fireplace has a rear wall 12, side walls 13—13 and a front wall 14. The front wall has an opening 15 to provide the recess for the fireplace which also opens upwardly into a chimney 16. As in most fireplaces, the side walls and front wall taper upwardly to the chimney.

The air heater 21, of the invention, fits in the recess between the side walls and is of unitary metallic structure, preferrably welded steel plate, so as to have good thermal transmission properties. The heater has a lower grate portion 22 having side walls 23—23, which fit against the side walls of the recess, and a back wall 24 which is spaced inwardly of the backwall of the fireplace so as to provide an air passage 26. The back wall 24, it is seen, has a vertical portion 27 and inwardly-sloped portion 28. A flue portion 31 is mounted on the upper end of the sloped wall 28. The flue portion tapers upwardly and has front and back walls 33 and 34, respectively, and side walls 35—35. The flue portion is open at its lower end 36 and at its upper end 37 to permit passage of products of combustion from the fireplace recess into the fireplace chimney. As is conventional, a damper 38 is pivotally mounted in the flue portion and is connected by a linking arm 39 to an operating handle 41 which is pivotally mounted on a fore and aft supporting 42 extending between the front and back wall of the flue portion. The damper can be suitably positioned between open and closed positions.

Extending downwards over and in spaced relationship to the sloped portion 28 of the back wall is a shiled 43 which extends between the side walls 23—23 and which meets, along its upper edge, a horizontal plate 44 which extends rearwardly from the back wall of the flue portion. The shield which is spaced at its lower edge 45 from the back wall of the lower portion and from the back wall 12 of the fireplace provides, a double-back wall which forms a heating chamber 46. The horizontal plate 44 is extended rearwardly and forms an upper wall of a vent 47, opening through an opening 46.1 in the shield, having a lower wall 48 and side walls 49—49, which extends toward the back wall 12 of the fireplace.

A plurality of air ducts, severally 53, extend transversely through the flue portion of the air heater and open at their inner ends 54 into the upper end of the heating chamber. The outer ends 55 of the ducts open through the front wall of the flue portion into a manifold 57 which extends outwards of the front wall of the flue portion. The manifold has upper and lower walls 58 and 59 and side walls, severally 61, and opens outwards through an opening 62 in the front wall of the fire place into the room.

Further, it is seen that the ducts 53 act as heat exchangers as they extend across the path of heated gases passing upwards through the flue portion.

Figure 4:
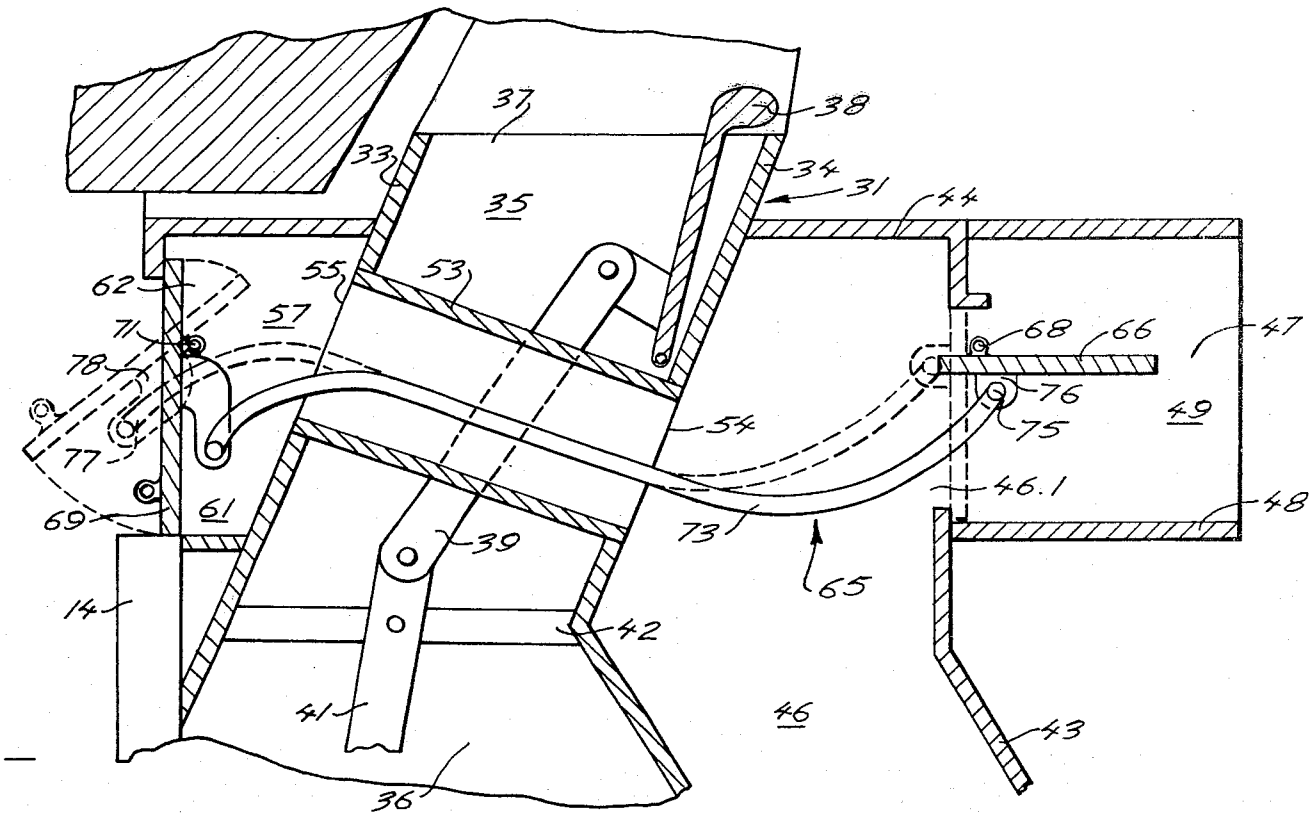
FIG. 4 is an enlarged central sectional side view of a portion of a valve arrangement as shown in FIG. 1.

Air flow from the heating chamber through the vent pipe and the air ducts is controlled by a manually operated valve assembly, generally 65, see FIGS. 1 and 4. The valve assembly includes a flap valve 66 mounted in the opening 46.1 of the vent pipe 47 for swinging movement on a cross-shaft 68 and a similar flap valve 69 which is mounted for swinging movement on a cross-shaft 71 at the open end of the manifold 57. The flap valves 66 and 69 are interconnected for cooperative movement by an operating 73 which extends through one of the ducts and has a pivotal connection at one end 75 to a bracket 76 extending from an inner surface of the flap valve 66 and also has a pivotal connection at its opposite end 7 to a bracket 78 which extends from the inner surface of the flap valve 69. Length of the operating rod 73 is such that with the flap valve 66 in the open position, as shown in solid outline in FIG. 4, the flap valve 69 is in its closed position, as shown in solid outline, and with the flap valve 66 closed, as shown in broken outline, the flap valve 69 is in its open position, as shown in broken outline.

With the air heater in position within the fireplace, see FIG. 1, the upper wall of the vent pipe engages the back wall 12 of the fireplace, and the lower edge of the shield is spaced from the back wall. The back wall 12 also has an opening 81 through which heated air exhausted through the vent pipe can escape and through which cool air, arrows 83, can enter the hearing chamber.

With the valve assembly adjusted to open the ducts and close the vent pipe, the air heater effectively uses most of the heat generated by burning combustibles for heating the room. The shield is heated by radiation from the back wall of the heater so that the air is heated as it moves downward over the shield and upwards through the heater. Heat products of combustion normally passing upwards to the chimney also heat the air passing through the ducts.

With the valve assembly adjusted to open the vent pipe and close the ducts, a great part of the heat generated by burning combustibles is wasted as the back wall of the heater being cooled by passage of air therethrough radiates much less than does a conventional fireplace wall.

I claim:

1. A fireplace heater, for installation in a fireplace in a room, comprising:

a. a lower grate portion open at its front and having a hollow back wall forming a heating chamber, said heating chamber being open at its lower end for receiving air from outside the room to be heated, b. an upper flue portion having front and side walls and having a hollow back wall communicating with the hollow back wall of the lower grate portion so as to form a common heating chamber, c. a plurality of air ducts extending transversely from back to front through the flue portion in the path of heated gases passing upwards through the flue portion, said ducts opening at inner ends into the heating chamber and opening out of the front wall of the flue portion for enabling discharge of heated air from the heating chamber into the room to be heated.

d. a vent pipe opening out of the back wall of the flue portion for enabling discharge of air from the heating chamber to a location outside of the room to be heated.

e. a manually operated valve assembly operable, selectively, to prevent flow of air through the air ducts when the vent pipe is open and to close the vent pipe to the passage of air when the air ducts are open.

2. An air heater as claimed in claim 1 in which the valve assembly includes:

a. a first flap valve in the vent pipe moveable between an open and a closed position.

b. a second flap valve for closing and opening the air ducts to flow of air therethrough, c. an operating arm connecting the air duct flap valve and the vent pipe flap valve operable when the air duct flap valve is moved from an open to a closed position to move the vent pipe flap valve from a closed to an open position.

3. An air heater as claimed in claim 2 in which the operating arm extends through one of the air ducts.

* * * * *